US008436802B2

(12) United States Patent
Yun

(10) Patent No.: US 8,436,802 B2
(45) Date of Patent: May 7, 2013

(54) LIQUID CRYSTAL DISPLAY DEVICE HAVING A LAMP SEQUENTIALLY TURNED ON ALONG A SCAN DIRECTION OF GATE LINES

(75) Inventor: Sang Chang Yun, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 1415 days.

(21) Appl. No.: 11/203,467

(22) Filed: Aug. 12, 2005

(65) Prior Publication Data

US 2006/0279516 A1 Dec. 14, 2006

(30) Foreign Application Priority Data

Jun. 10, 2005 (KR) ..... 10-2005-0050076

(51) Int. Cl.
*G09G 3/36* (2006.01)

(52) U.S. Cl.
USPC ..... 345/102

(58) Field of Classification Search ..... 345/87–102, 345/211–213; 315/291, 323–325
See application file for complete search history.

(56) References Cited

U.S. PATENT DOCUMENTS

| | | | | |
|---|---|---|---|---|
| 7,091,947 | B2 * | 8/2006 | Hsieh | 345/102 |
| 7,239,093 | B2 * | 7/2007 | Hsieh | 315/291 |
| 7,304,633 | B2 * | 12/2007 | Kim et al. | 345/102 |
| 7,348,959 | B2 * | 3/2008 | Kim | 345/102 |
| 2002/0008694 | A1 * | 1/2002 | Miyachi et al. | 345/204 |
| 2002/0093480 | A1 * | 7/2002 | Mizutani et al. | 345/102 |
| 2004/0017348 | A1 * | 1/2004 | Numao | 345/92 |
| 2005/0083282 | A1 * | 4/2005 | Honbo | 345/87 |
| 2005/0212737 | A1 * | 9/2005 | Yoshihara et al. | 345/87 |
| 2006/0132066 | A1 * | 6/2006 | Winer et al. | 315/363 |

* cited by examiner

*Primary Examiner* — Rodney Amadiz
(74) *Attorney, Agent, or Firm* — Brinks Hofer Gilson & Lione

(57) ABSTRACT

A liquid crystal display device includes a liquid crystal display panel having a gate line sequentially selected by a gate pulse and a plurality of light sources which are sequentially turned on along a scan direction of the gate line. The plurality of light sources are turned on with a first level of brightness during a white turn-on period, and turned on with a second level of brightness during a gray turn-on period. The second level of brightness is lower than the first level of brightness to irradiate the liquid crystal display panel with light. As a result, a life span of the plurality of light sources may be extended.

13 Claims, 7 Drawing Sheets

LIQUID CRYSTAL DISPLAY DEVICE HAVING A LAMP SEQUENTIALLY TURNED ON ALONG A SCAN DIRECTION OF GATE LINES

This application claims the benefit of Korean Patent Application No. P2005-50076 filed in Korea on Jun. 10, 2005, which is hereby incorporated by reference in its entirety.

BACKGROUND

1. Technical Field

The invention relates to a liquid crystal display device, and more particularly, to a liquid crystal display device with an extended life span of a lamp.

2. Related Art

A liquid crystal display device controls a light transmittance of liquid crystal cells in response to a video signal to display pictures corresponding to the video signals. A liquid crystal display device of a matrix type has a switching device arranged for every liquid crystal cell so that it is suitable for the display of a moving picture. The switching device mainly employs a thin film transistor (TFT).

The liquid crystal display device may not be a light-emitting device, so that it requires a backlight unit. A scanning backlight is a sequentially blinking lamp along a scan direction of an indicating line, as shown in FIGS. 1A to 1D. The scanning backlight applies to the liquid crystal display device to reduce a motion blurring sensed by an observer due to a maintaining characteristic of a liquid crystal material when displaying a motion picture through the liquid crystal display device. A life span of backlight lamps becomes shortened because a driving voltage applied to the lamps Ln-2, Ln-1 and Ln (see FIG. 2) repeats turning-on and turning-off by a frame period of 16.67 ms unit as shown in FIGS. 1A-1D. Accordingly, there is a need of a liquid crystal display device that may extend a life span of a backlight lamp.

SUMMARY

By way of introduction only, in one embodiment, a liquid crystal display device includes a liquid crystal display panel having a gate line sequentially selected by a gate pulse and a plurality of light sources. The plurality of light sources is operable to be sequentially turned on along a scan direction of the gate line. The plurality of light sources is turned on with a first level of brightness during a white turn-on period and is turned on with a second level of brightness during a gray turn-on period. The second level of brightness is lower than the first level of brightness.

In other embodiment, a method of driving a liquid crystal display device is provided. A plurality of light sources is sequentially turned on along a scan direction of the gate lines. The plurality of light sources is turned on with a first level of brightness during a white turn-on period. The plurality of light sources is turned on with a second level of brightness during a gray turn-on period. The second level of brightness is lower than the first level of brightness.

In another embodiment, a liquid crystal display device having a liquid crystal display panel and a light source is provided. The liquid crystal display panel includes a gate line sequentially selected by a gate pulse and a plurality of pixels. The light source is operable to be sequentially turned on along a scan direction of the gate line. The light source emits light during a first period and a second period. A pixel holds a data voltage charged therein during the first period and the pixel discharges the data voltage during the second period.

BRIEF DESCRIPTION OF THE DRAWINGS

These and other objects of the invention will be apparent from the following detailed description of the embodiments with reference to the accompanying drawings, in which.

DETAILED DESCRIPTION OF THE PREFERRED EMBODIMENT

Figure 1A:
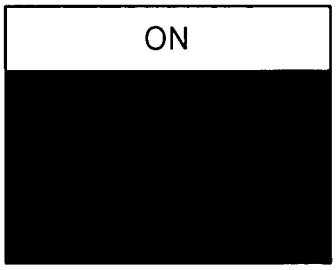
FIG.1A RELATED ART
FIGS. 1A to 1D are diagrams showing a sequential blink of a related art scanning backlight.
Figure 1B:
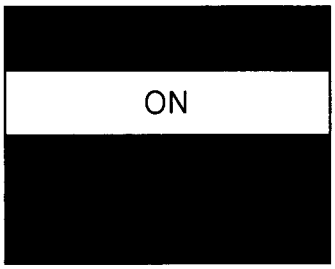
FIG.1B RELATED ART
Figure 1C:
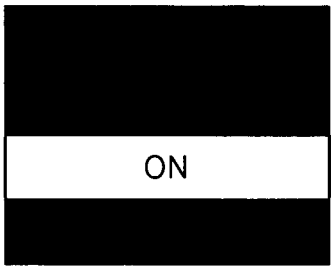
FIG.1C RELATED ART
Figure 1D:
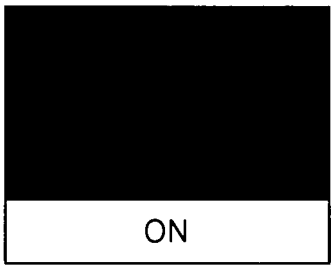
FIG.1D RELATED ART
Figure 2:
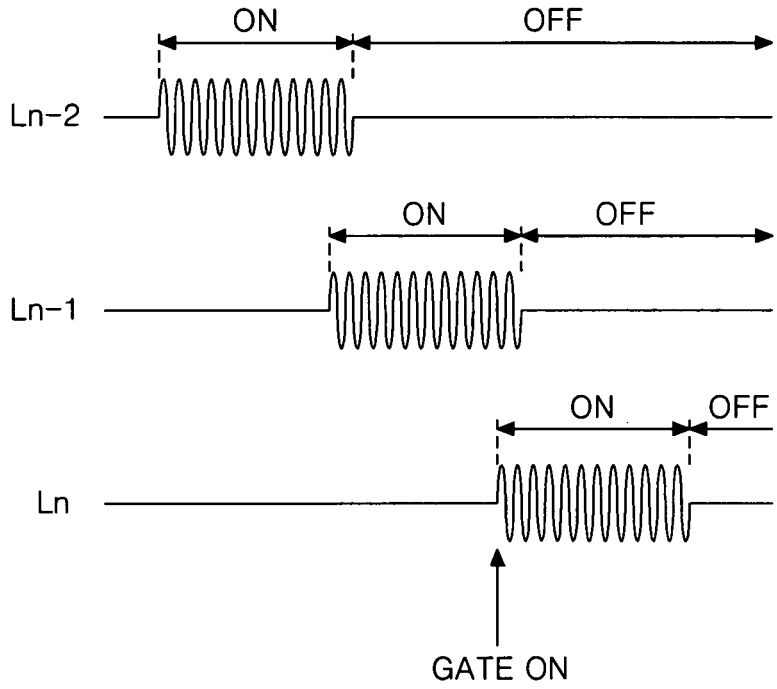
FIG. 2 RELATED ART
FIG. 2 is a waveform diagram showing a driving voltage applied to lamps in the related art scanning backlight.
Figure 3:
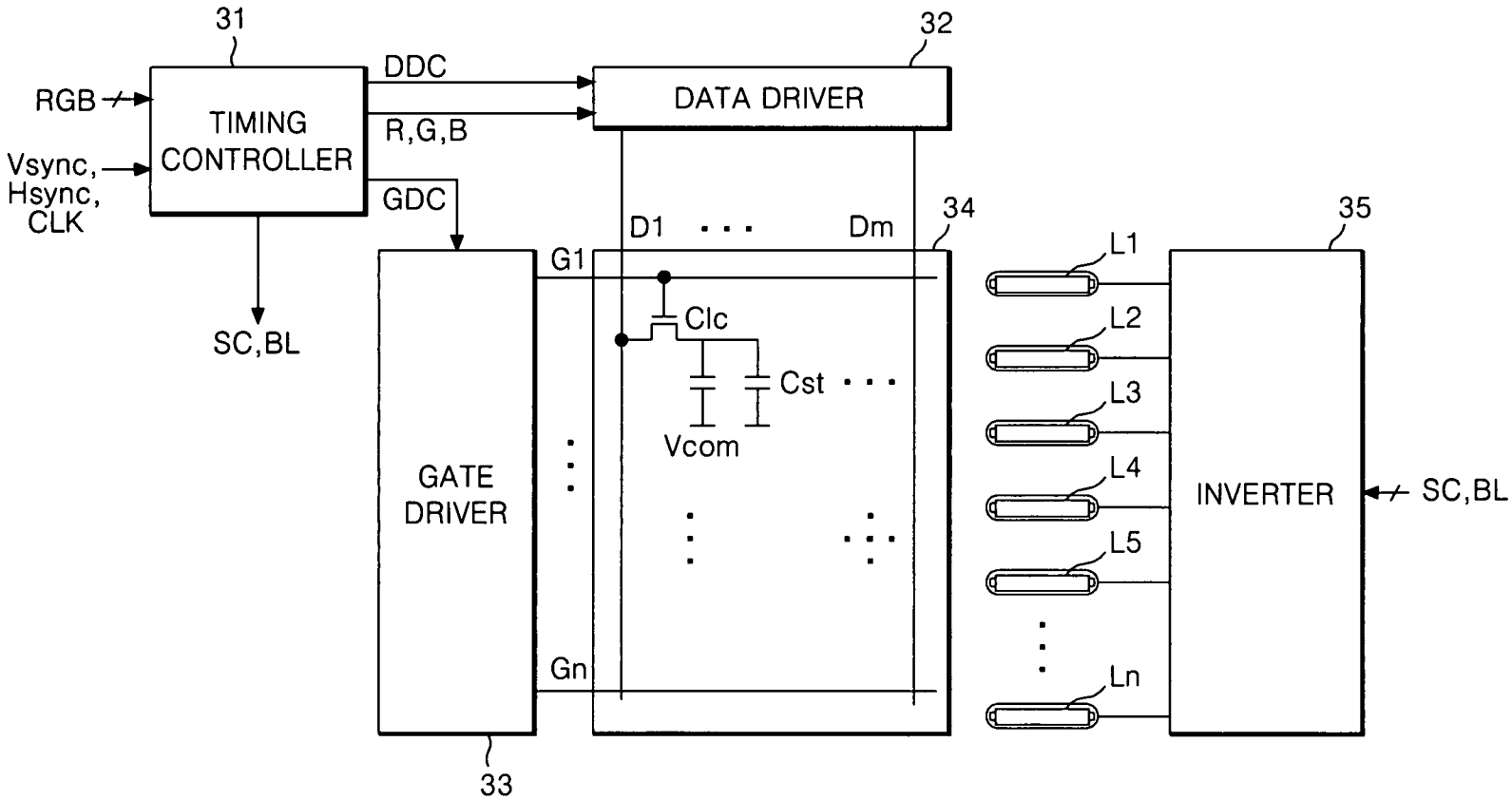
FIG. 3 is a block diagram showing a liquid crystal display device.

Referring to FIG. 3, a liquid crystal display device according to an embodiment includes a timing controller 31, a data driver 32, a gate driver 33, a liquid crystal display panel 34 and an inverter 35. In the liquid crystal display panel 34, data lines D1 to Dm intersect gate lines G1 to Gn, respectively. A thin film transistor TFT is arranged at each intersection for driving a liquid crystal cell CIc. The data driver 32 supplies data to the data lines D1 to Dm of the liquid crystal display panel 34. The gate driver 33 supplies a scanning pulse to the gate lines G1 to Gn of the liquid crystal display panel 34. A plurality of lamps L1 to Ln irradiates the liquid crystal display panel 34 with light. The inverter 35 drives the lamps L1 to Ln and the timing controller 31 controls the data driver 32, the gate driver 33 and the inverter 35.

The liquid crystal panel 34 has a liquid crystal material injected between two grass substrates, i.e., upper and lower grass substrates. The data lines D1 to Dm and the gate lines G1 to Gn are formed on the lower grass substrate. The TFT arranged at each intersection of the data lines D1 to Dm and the gate lines G1 to Gn supplies data of the data lines D1 to Dm to the liquid crystal cell CIc in response to scanning pulses from the gate lines G1 to Gn. A gate electrode of the TFT is connected to the gate lines G1 to Gn, and a source electrode of the TFT is connected to the data lines D1 to Dm. Further, a drain electrode of the TFT is connected to a pixel electrode of the liquid crystal cell CIc and a storage capacitor Cst. A common voltage Vcom is supplied to a common electrode facing the pixel electrode. Further, storage capacitors for keeping a voltage of the liquid crystal cell constant are formed in the liquid crystal display panel 34.

The data driver 32 supplies digital video data R, G and B from the timing controller 31 to the data lines D1 to Dm of the liquid crystal display panel 34 in response to a data control signal DDC. The gate driver 33 sequentially supplies a scanning pulse to the gate lines G1 to Gn in response to a gate control signal GDC.

The timing controller 31 supplies the digital video data R, G, B supplied from a system (not shown) to the data driver 32 and generates the gate control signal GDC for controlling the gate driver 33 and the data control signal DDC for controlling the data driver 32 by using vertical/horizontal synchronization signals Vsync and Hsync. The data control signal DDC includes a source start pulse SSP, a source shift clock SSC, a source output enable SOE and a polarity signal POL etc. The polarity signal POL is a signal indicating a polarity of a data voltage. The gate control signal includes a gate start pulse GSP, a gate shift clock GSC and a gate output enable GOE etc. Further, the timing controller 31 supplies a scanning control signal SC and a brightness control signal BL to the inverter 35 to control the inverter 35.

Figure 4:
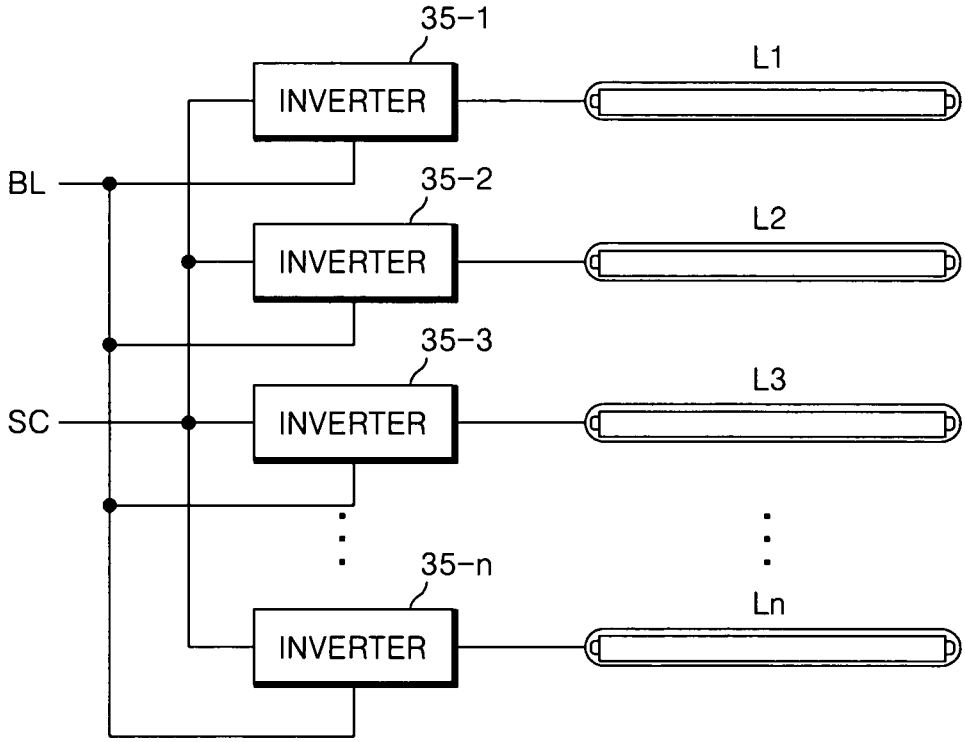
FIG. 4 is a detailed diagram showing inverters and lamps of FIG. 3.

The inverter 35 sequentially turns on lamps L1 to Ln along a scan direction of the gate lines G1-Gn in response to the scanning control signal SC and lowers a brightness of the lamps L1 to Ln during a non-scan period of the gate lines G1-Gn in response to the brightness control signal BL. The inverter 35 may drive the lamps L1 to Ln to emit light during the non-scan period. The inverter 35 includes a plurality of inverters 35-1 to **35-*n* for independently driving each of lamps L1 to Ln as shown in FIG. 4. Each of inverters 35-1 to 35-*n* converts a direct current voltage into an alternating current voltage and boosts the voltage to generate a lamp driving waveform. Accordingly, each of the inverters 35-1 to 35-*n* synchronizes a point of turn-on time of the lamps L1 to Ln with a point of scanning time of the gate lines in response to the scanning control signal SC. The inverters 35-1 to 35-*n* also modulate a lamp driving voltage by a pulse width modulation (PWM) or a pulse amplitude modulation (PAM) to adjust brightness in response to the brightness control signal BL. The brightness control signal BL controls the inverters 35-1 to 35-*n*** in the PWM control or the PAM control to adjust brightness.

As noted above, the lamps L1 to Ln emit light during the scanning period and the non-scanning period. During the scanning period, a pixel holds a data voltage charged therein and during the non-scanning period, the pixel discharges the data voltage. The lamps L1 to Ln continue to emit light and change the brightness level depending on the scanning period or the non-scanning period.

The lamps L1 to Ln emit with a high brightness of 60% to 100% of a maximum brightness during a white turn-on period. On the other hand, the lamps L1 to Ln emit a low brightness of 10% to 40% of the maximum brightness during a gray turn-on period by the inverter 35. The lamps L1 to Ln may have an extended life span, when compared with the scanning backlight lamps which are periodically blinked by turning-on and turning-off. As shown in FIGS. 1A-1D, the related art scanning backlight lamps emit a brightness of 60% to 100% of the maximum brightness during the turn-on period and emit 0% brightness of the maximum brightness, so that it has a short life span.

Figure 5:
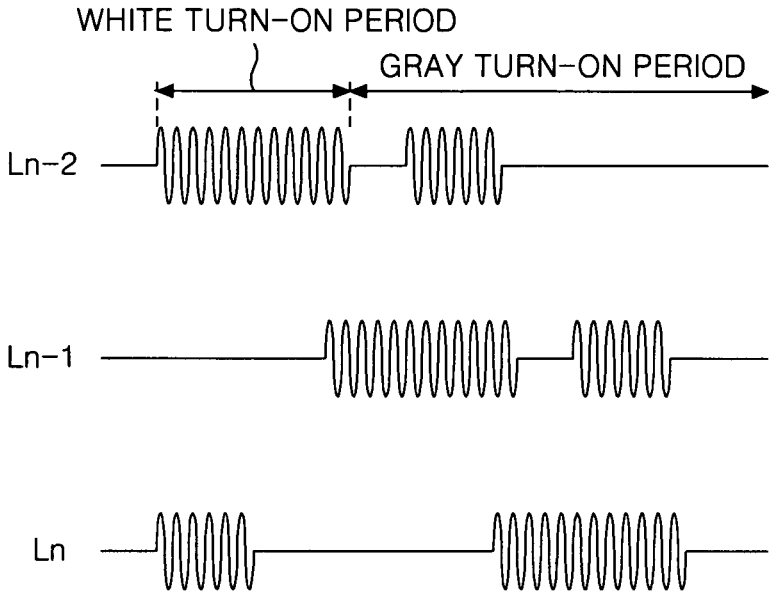
FIG. 5 is a driving waveform diagram showing a voltage for driving the lamps of FIG. 3 according to a first embodiment.

FIG. 5 shows a driving voltage waveform of the lamps representing a brightness control of the lamps L1 to Ln by the PWM control according to a first embodiment. The driving waveforms in FIG. 5 are generated from the inverters 35-1 to **35-*n*** controlled by the PWM control in accordance with the scanning control signal SC and the brightness control signal BL.

Referring to FIG. 5, the lamps Ln-2, Ln-1 and Ln are sequentially turned on along the scan direction of the gate lines. Each of the lamps Ln-2, Ln-1, and Ln is turned on with a duty ratio of about 60% to 100% of the white turn-on period by the PWM control. On the other hand, the lamps Ln-2, Ln-1 and Ln are turned on with a duty ratio of about 10% to 40% of the gray turn-on period.

Figure 6:
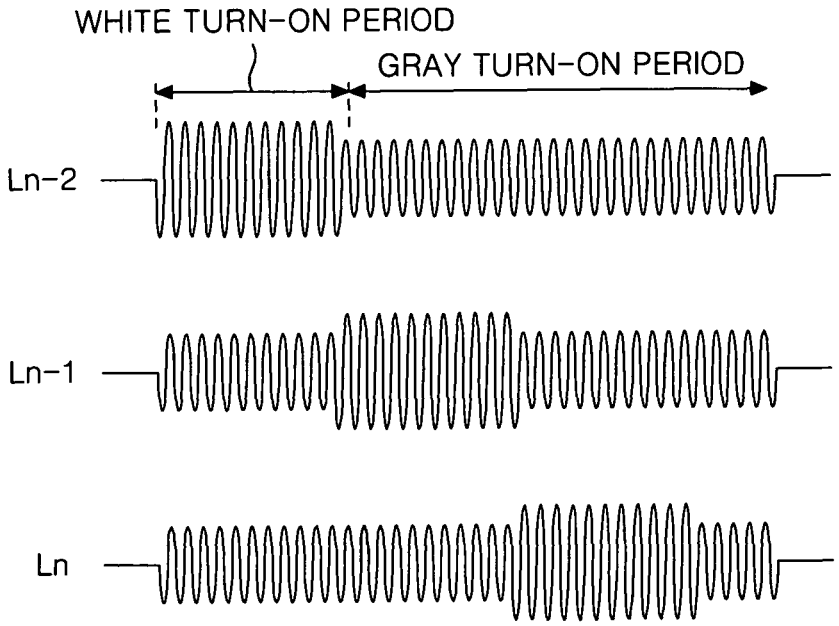
FIG. 6 is a driving waveform diagram showing a voltage for driving the lamps of FIG. 3 according to a second embodiment.

FIG. 6 shows a driving voltage waveform of the lamps representing a brightness control of the lamps L1 to Ln by the PAM control according to a second embodiment. The driving waveforms in FIG. 6 are generated from the inverters 35-1 to **35-*n*** controlled by the scanning control signal SC and the brightness control signal BL.

Referring to FIG. 6, the lamps Ln-2, Ln-1 and Ln are sequentially turned on in a high brightness and a relatively low brightness along the scan direction of the gate lines. Each of the lamps Ln-2, Ln-1, and Ln is turned on in amplitude of about 60% to 100% of a maximum peak-to-peak during the white turn-on period by the PAM control. On the other hand, the lamps Ln-2, Ln-1 and Ln are turned on in amplitude of about 10% to 40% of the maximum amplitude during the gray turn-on period.

As described above, in the liquid crystal display device and the driving method, the white turn-on period of the light sources is synchronized along the scan direction of the gate lines to sequentially turn on the light sources. Accordingly, it is possible to reduce a motion blurring of a moving picture. Further, brightness of the light sources may be lowered during the gray turn-on period corresponding the non-scan period of the gate lines. The lamp emits light during the scanning period and the non-scanning period. Periodic turning-on and turning-off of the lamp may be substantially avoided. Accordingly, a life span of the light sources may be extended with the scanning backlight driving.

Various changes or modifications thereof are possible without departing from the spirit of the invention. Accordingly, the scope of the invention shall be determined only by the appended claims and their equivalents.

What is claimed is:

1. A liquid crystal display device comprising:

a liquid crystal display panel having a plurality of pixels wherein a data voltage signal is applied to the pixels, and each of a plurality of gate lines being sequentially selected by applying a gate pulse within a period, wherein the period comprises both a first duration and a second duration, wherein throughout the first duration, a selected gate line is scanned and the gate pulse is applied, and throughout the second duration, the selected gate line is not scanned and no gate pulse is applied;

a plurality of light sources operable to be sequentially turned on according to the first and the second duration along a scan direction of the plurality of the gate lines, the plurality of light sources are turned on with a first level of brightness in response to a scanning control signal during a white turn-on period, wherein the white turn-on period corresponds to the first duration of the period, and the plurality of light sources are turned on with a second level of brightness throughout a gray turn-on period, wherein the gray turn-on period corresponds to the second duration of the period, and wherein the second level of brightness is lower than the first level of brightness and higher than or equal to 10% of a maximum brightness; and a controller operable to drive a plurality of inverters with pulse width modulation, wherein the controller synchronizes the scan direction of the plurality of gate lines with a turn-on scan direction of the plurality of light sources, wherein the controller supplies the scanning control signal and a brightness control signal to the plurality of inverters, wherein a pixel holds a data voltage charged therein during the white turn-on period and the pixel discharges the data voltage during the gray turn-on period, and wherein the plurality of inverters sequentially turns on the plurality of light sources along the scan direction of the plurality of gate lines in response to the scanning control signal, the light sources being turned on to the first level of brightness during the white turn-on period and lowered to the second level of brightness throughout the gray turn-on period in response to the brightness control signal.

2. The liquid crystal display device according to claim 1, wherein the first level of brightness corresponds to 60%-100% of the maximum brightness and the second level of brightness corresponds to 10%-40% of the maximum brightness.

3. The liquid crystal display device according to claim 1, wherein the first level of brightness corresponds to 60%-100% of a peak amplitude and the second level of brightness corresponds to 10%-40% of the peak amplitude.

4. The liquid crystal display device according to claim 1, wherein the first level of brightness corresponds to a first duty ratio and the second level of brightness corresponds to a second duty ratio.

5. The liquid crystal display device according to claim 4, wherein the first duty ratio corresponds to 60-100% of the white turn-on period in the first duration.

6. The liquid crystal display device according to claim 4, wherein the second duty ratio corresponds to 10-40% of the gray turn-on period in the second duration.

7. The liquid crystal display device according to claim 1, wherein the plurality of light sources operate to emit light during throughout the gray turn-on period in the second duration.

8. A liquid crystal display device, comprising:

a liquid crystal display panel comprising a plurality of pixels wherein a data voltage signal is applied to the pixels, and each of a plurality of gate lines being sequentially selected by applying a gate pulse within a period, wherein the period comprises both a first duration and a second duration, wherein throughout the first duration, a selected gate line is scanned and the gate pulse is applied, and throughout the second duration, the selected gate line is not scanned and no gate pulse is applied;

a light source operable to be sequentially turned on according to the first and the second duration along a scan direction of the plurality of the gate lines, the light source emitting light throughout the first duration and the second duration, wherein a pixel holds a data voltage charged therein during the first duration and the pixel discharges the data voltage during the second duration; and a controller operable to drive a plurality of inverters with at least one of a pulse width modulation or a pulse amplitude modulation, wherein the controller synchronizes the scan direction of the plurality of gate lines with a turn-on scan direction of the plurality of light sources, wherein the controller supplies the scanning control signal and a brightness control signal to the plurality of inverters, wherein the plurality of inverters sequentially turns on the plurality of light sources along the scan direction of the plurality of gate lines in response to the scanning control signal, the light sources being turned on to a first level of brightness during the first duration of the period and lowered to a second level of brightness throughout the second duration of the period in response to the brightness control signal, and wherein the light sources comprise a first brightness level during the first period and a second brightness level higher than or equal to 10% of a maximum brightness throughout the duration of the second period, the first brightness level being higher than the second brightness level.

9. The liquid crystal display device of claim 8, wherein the second brightness level corresponds to 10%-40% of the maximum brightness.

10. A method of driving a liquid crystal display device comprising:

sequentially applying a gate pulse within a period to select each of a plurality of gate lines of a liquid crystal display panel, wherein the period comprises both a first duration and a second duration, wherein throughout the first duration, a selected gate line is scanned and the gate pulse is applied, and throughout the second duration, the selected gate line is not scanned and no gate pulse is applied;

supplying a scanning control signal and a brightness control signal to a plurality of inverters;

controlling a plurality of light sources with at least one of a pulse width modulation or a pulse amplitude modulation to control brightness;

sequentially turning on a plurality of light sources according to the first and the second duration along a scan direction of the plurality of the gate lines;

turning on the plurality of light sources with a first level of brightness in response to a scanning control signal during a white turn-on period, wherein the white turn-on period corresponds to the first duration of the period;

turning on the plurality of light sources with a second level of brightness throughout the gray turn-on period, wherein the gray turn-on period corresponds to the second duration of the period, and wherein the second level of brightness is lower than the first level of brightness and higher than or equal to 10% of a maximum brightness; and synchronizing the scan direction of the plurality of gate lines with a turn-on scan direction of the plurality of light sources, holding a data voltage charged in a pixel during the first duration of the period and discharging the data voltage in the pixel during the second duration of the period, wherein the plurality of inverters sequentially turns on the plurality of light sources along the scan direction of the plurality of gate lines in response to the scanning control signal, the light sources being turned on to the first level of brightness during the first duration of the period and lowered to the second level of brightness throughout the second duration of the period in response to the brightness control signal.

11. The method according to claim 10, further comprising controlling a level of brightness with a different duty ratio of the white turn-on period and the gray turn-on period.

12. The method according to claim 10, further comprising controlling a level of brightness with a different amplitude of light from the plurality of light sources during the white turn-on period and the gray turn-on period.

13. The method according to claim 10, further comprising emitting light at the plurality of light sources throughout the gray turn-on period.

* * * * *